US005870830A

United States Patent [19]

Wu

[11] Patent Number: 5,870,830

[45] Date of Patent: Feb. 16, 1999

[54] CONIC SECTION COMPASS

[76] Inventor: Yen-Hung Wu, 14 Summer Rd., Brookline, Mass. 02146

[21] Appl. No.: 835,377

[22] Filed: Apr. 7, 1997

[51] Int. Cl.[6] ..... B43L 9/02; B43L 11/04

[52] U.S. Cl. ..... 33/27.01; 033/21.1; 033/27.02; 033/30.1; 033/30.6

[58] Field of Search ..... 33/27.01, 18.1, 33/21.1, 21.2, 21.3, 27.02, 27.03, 27.031, 27.032, 27.04, 27.06, 30.1, 30.6, 30.2

[56] References Cited

U.S. PATENT DOCUMENTS

| | | | |
|---|---|---|---|
| 2,460,826 | 2/1949 | Hooser et al. | 33/30.6 |
| 2,470,328 | 5/1949 | Towle | 33/30.6 |
| 2,859,522 | 11/1958 | Thomas | 33/21.3 |
| 3,100,346 | 8/1963 | Cannon | 33/21.3 |
| 4,204,327 | 5/1980 | Danial | 33/30.6 |

*Primary Examiner*—Christopher W. Fulton

[57] ABSTRACT

Conic Section Compass (CSC) is a hand-held drawing device. It applies a mathematics concept. CSC can be used to draw circles, ellipses, parabolas, hyperbolas or make surface curvatures of these types. Given a specific mathematics formula of the mentioned curves, users can draw a well defined curve with CSC (just like a compass to drawing a circle).

1 Claim, 12 Drawing Sheets

Figure 5.2 circle radius = 2
angle = 60
slope of the cone = tan(90-60)
distance from vertex to cross section = 1.155

Figure 7.1 circle radius = 2
angle = 30
slope of the cone = tan(90-30)
distance from vertex to cross section = 3.46

Figure 8

| angle of the arm in° | circle $x^2+y^2=r^2$ r = | parabola $y=ax^2+k$ a = | hyperbola $x^2/a^2-y^2/b^2=1$ a/b = |
|---|---|---|---|
| 1 | 0.705 | 25.249 | 57.290 |
| 2 | 0.785 | 11.868 | 28.636 |
| 3 | 0.865 | 7.463 | 19.081 |
| 4 | 0.946 | 5.296 | 14.301 |
| 5 | 1.027 | 4.019 | 11.430 |
| 6 | 1.108 | 3.185 | 9.514 |
| 7 | 1.190 | 2.602 | 8.144 |
| 8 | 1.272 | 2.174 | 7.115 |
| 9 | 1.355 | 1.849 | 6.314 |
| 10 | 1.439 | 1.594 | 5.671 |
| 11 | 1.524 | 1.391 | 5.145 |
| 12 | 1.609 | 1.225 | 4.705 |
| 13 | 1.695 | 1.088 | 4.331 |
| 14 | 1.782 | 0.973 | 4.011 |
| 15 | 1.870 | 0.876 | 3.732 |
| 16 | 1.958 | 0.793 | 3.487 |
| 17 | 2.048 | 0.721 | 3.271 |
| 18 | 2.140 | 0.658 | 3.078 |
| 19 | 2.232 | 0.604 | 2.904 |
| 20 | 2.326 | 0.555 | 2.747 |
| 21 | 2.421 | 0.513 | 2.605 |
| 22 | 2.517 | 0.475 | 2.475 |
| 23 | 2.616 | 0.440 | 2.356 |
| 24 | 2.716 | 0.410 | 2.246 |
| 25 | 2.817 | 0.382 | 2.145 |
| 26 | 2.921 | 0.357 | 2.050 |
| 27 | 3.026 | 0.334 | 1.963 |
| 28 | 3.134 | 0.314 | 1.881 |
| 29 | 3.244 | 0.295 | 1.804 |
| 30 | 3.356 | 0.277 | 1.732 |
| 31 | 3.471 | 0.261 | 1.664 |
| 32 | 3.588 | 0.246 | 1.600 |
| 33 | 3.708 | 0.233 | 1.540 |
| 34 | 3.831 | 0.220 | 1.483 |
| 35 | 3.958 | 0.208 | 1.428 |
| 36 | 4.087 | 0.197 | 1.376 |
| 37 | 4.221 | 0.187 | 1.327 |
| 38 | 4.358 | 0.178 | 1.280 |
| 39 | 4.499 | 0.169 | 1.235 |
| 40 | 4.644 | 0.160 | 1.192 |
| 41 | 4.794 | 0.153 | 1.150 |
| 42 | 4.949 | 0.145 | 1.111 |
| 43 | 5.109 | 0.138 | 1.072 |
| 44 | 5.275 | 0.132 | 1.036 |
| 45 | 5.446 | 0.126 | 1.000 |
| 46 | 5.624 | 0.120 | 0.966 |
| 47 | 5.809 | 0.114 | 0.933 |
| 48 | 6.001 | 0.109 | 0.900 |
| 49 | 6.201 | 0.104 | 0.869 |
| 50 | 6.410 | 0.099 | 0.839 |
| 51 | 6.627 | 0.095 | 0.810 |
| 52 | 6.855 | 0.091 | 0.781 |
| 53 | 7.093 | 0.086 | 0.754 |
| 54 | 7.343 | 0.083 | 0.727 |
| 55 | 7.606 | 0.079 | 0.700 |
| 56 | 7.882 | 0.075 | 0.675 |
| 57 | 8.173 | 0.072 | 0.649 |
| 58 | 8.481 | 0.069 | 0.625 |
| 59 | 8.807 | 0.065 | 0.601 |
| 60 | 9.152 | 0.062 | 0.577 |
| 61 | 9.520 | 0.059 | 0.554 |
| 62 | 9.912 | 0.057 | 0.532 |
| 63 | 10.331 | 0.054 | 0.510 |
| 64 | 10.780 | 0.051 | 0.488 |
| 65 | 11.263 | 0.049 | 0.466 |
| 66 | 11.784 | 0.046 | 0.445 |
| 67 | 12.348 | 0.044 | 0.424 |
| 68 | 12.961 | 0.041 | 0.404 |
| 69 | 13.630 | 0.039 | 0.384 |
| 70 | 14.363 | 0.037 | 0.364 |
| 71 | 15.170 | 0.035 | 0.344 |
| 72 | 16.064 | 0.033 | 0.325 |
| 73 | 17.061 | 0.031 | 0.306 |
| 74 | 18.179 | 0.029 | 0.287 |
| 75 | 19.442 | 0.027 | 0.268 |
| 76 | 20.883 | 0.025 | 0.249 |
| 77 | 22.541 | 0.023 | 0.231 |
| 78 | 24.471 | 0.021 | 0.213 |
| 79 | 26.748 | 0.019 | 0.194 |
| 80 | 29.474 | 0.017 | 0.176 |
| 81 | 32.802 | 0.015 | 0.158 |
| 82 | 36.955 | 0.014 | 0.141 |
| 83 | 42.287 | 0.012 | 0.123 |
| 84 | 49.389 | 0.010 | 0.105 |
| 85 | 59.321 | 0.008 | 0.087 |
| 86 | 74.207 | 0.007 | 0.070 |
| 87 | 99.000 | 0.005 | 0.052 |
| 88 | 148.561 | 0.003 | 0.035 |
| 89 | 297.197 | 0.002 | 0.017 |
| 90 | - | 0.000 | 0.000 |

CONIC SECTION COMPASS

TECHNICAL FIELD OF THE INVENTION

This invention relates to a hand-held drawing device. Specifically, it helps users to draw well-defined circles, ellipses, parabolas, hyperbolas and make surface curvatures of these types.

BACKGROUND

When drawing ellipses, parabolas and hyperbolas, people usually 1) calculate several obvious points first, 2) plot the points on a coordinate axis, and 3) try to eye-ball-fitting these points to form the curve.

There are several downfalls to this procedure. First, people need to calculate at least 4 points on the curve (usually the vertex or foci). And if a better drawing must be obtained, it requires more than just 4 points. Calculating these other points often requires using a calculator; it takes time and is inconvenient. Second, drawing axis and plotting spacing and points can very easily build up errors. Before you know it, the axial unit is not equally spaced, and the points are off. Finally, people rarely draw the curve or connecting the points just once—it never looks good at the first try and often takes several practices. People end up tracing the curve over and over, and the line just becomes very thick. When it becomes messy, people need to erase the curve and start over. And erasing usually makes paper wrinkled or messier. To summarize, it is difficult to obtain a satisfactory graph quickly and conveniently.

In general, free-hand sketching has a negative impact on the quality of a graph. This is why a compass is used to draw circles, and an ellipsograph is used to draw ellipses. These two devices help people to draw very well-defined curves.

Another subject is that telescope mirror-makers use a spherical surface to approximate the ideal parabolic surface. This approximation leads to a poorer image quality.

OBJECTIVES AND ADVANTAGES OF THE INVENTION

Several objectives and advantages of CSC are:

1). CSC allows users to draw well-defined circles, ellipses, parabolas, hyperbolas or make surface curvatures of these kinds continuously. Using CSC does not involve calculating, plotting, connecting, fitting and sketching the curve or points.

2). CSC is as easy to use as a conventional compass. It takes about the same time to draw circles, ellipses, parabolas and hyperbolas with CSC as it takes to draw circles by a conventional compass. It certainly takes less time compares to the point-plotting method, when a good quality graph must be achieved.

3). CSC does not leave holes on paper.

4). CSC can be used to draw small curves as well as large ones.

5). CSC is very portable. It has only ±9 simple geometric parts, and it fits into any hand bag just like a compass.

6). CSC can be used to accurately define the parabolic and hyperbolic surface curvatures.

Further objectives and advantages of CSC will become apparent from a consideration of the drawings and the following descriptions.

DESCRIPTION OF THE DRAWING

FIG. 8 is an index for a specific CSC; the index shows the CSC settings for a mathematically defined curve.

NUMBER AND REFERENCE IN THE DRAWINGS

1. angle fixture
1*a*. hole in 1
1*b*. hole in 1
1*c*. hole in 1
1*d*. side surface on 1
2. arm
3. upper central axis
3*a*. hole in 3
3*b*. hole in 3
4. vertical pin
5. horizontal pin
5*a*. hole in 5
5*b*. hole in 5
6. pin
7. lower central axis
7*a*. hole in 7
7*b*. hole in 7
8. screw
9. base
9*a*. hole in 9
9*b*. side surface on 9

DETAILED DESCRIPTION OF THE INVENTION

Figure 1:
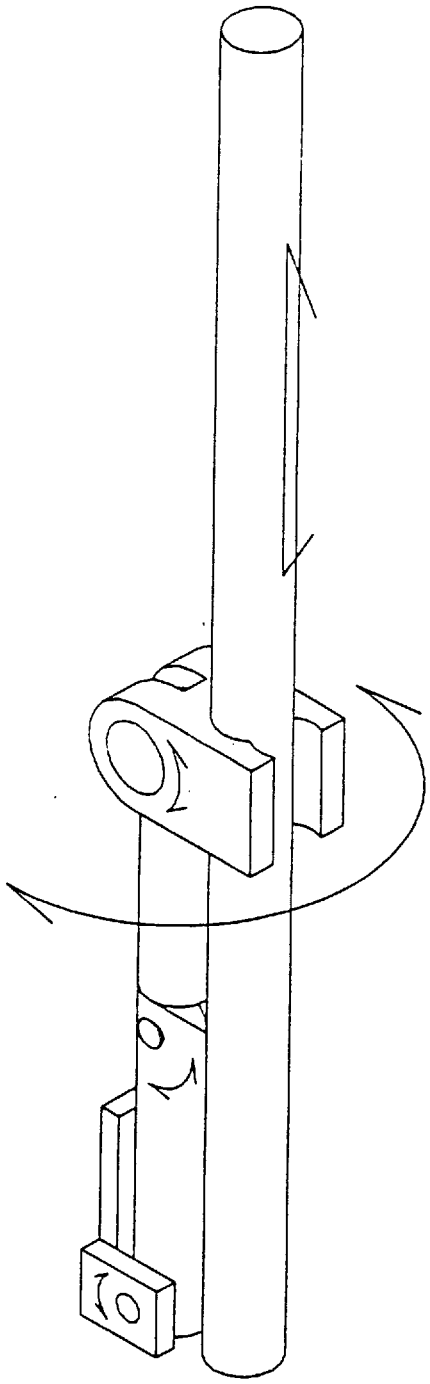
FIG. 1 shows the front isometric view of the Conic Section Compass.

FIG. 1 is a front isometric view of CSC. Some alternative details can be implemented to give CSC better accuracy or different graph-size. However, this is what CSC generally looks like.

Figure 2:
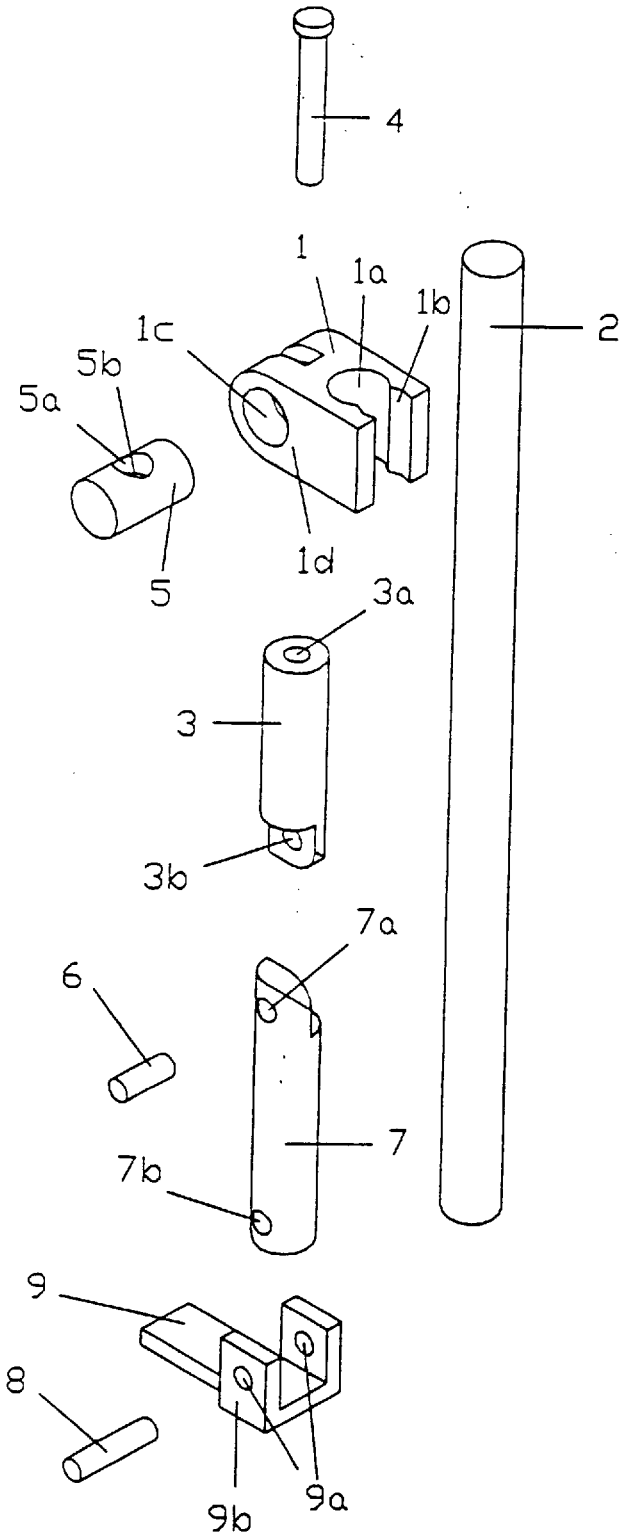
FIG. 2 shows the exploded view of CSC and its components.

FIG. 2 shows the components of CSC at their relative assembly position. The device comprises an angle fixture 1, arm 2, upper central axis 3, vertical pin 4, horizontal pin 5, pin 6, lower central axis 7, screw 8, and base 9.

Any part number accompanied by a lower case letter is a specific hole on that part.

The following discussion on the sizes refers to the diameter of the pins and the diameter of the holes. If a pin and a hole interference fit each other, the two parts rub and resist to move relatively to each other (rotation, translation or both) at all time. If a pin and a hole clearance fit each other, the two parts are free to move relatively to each other at all time. The purpose of resisting or allowing relative motion between 2 parts will become apparent in the later section.

Figure 3:
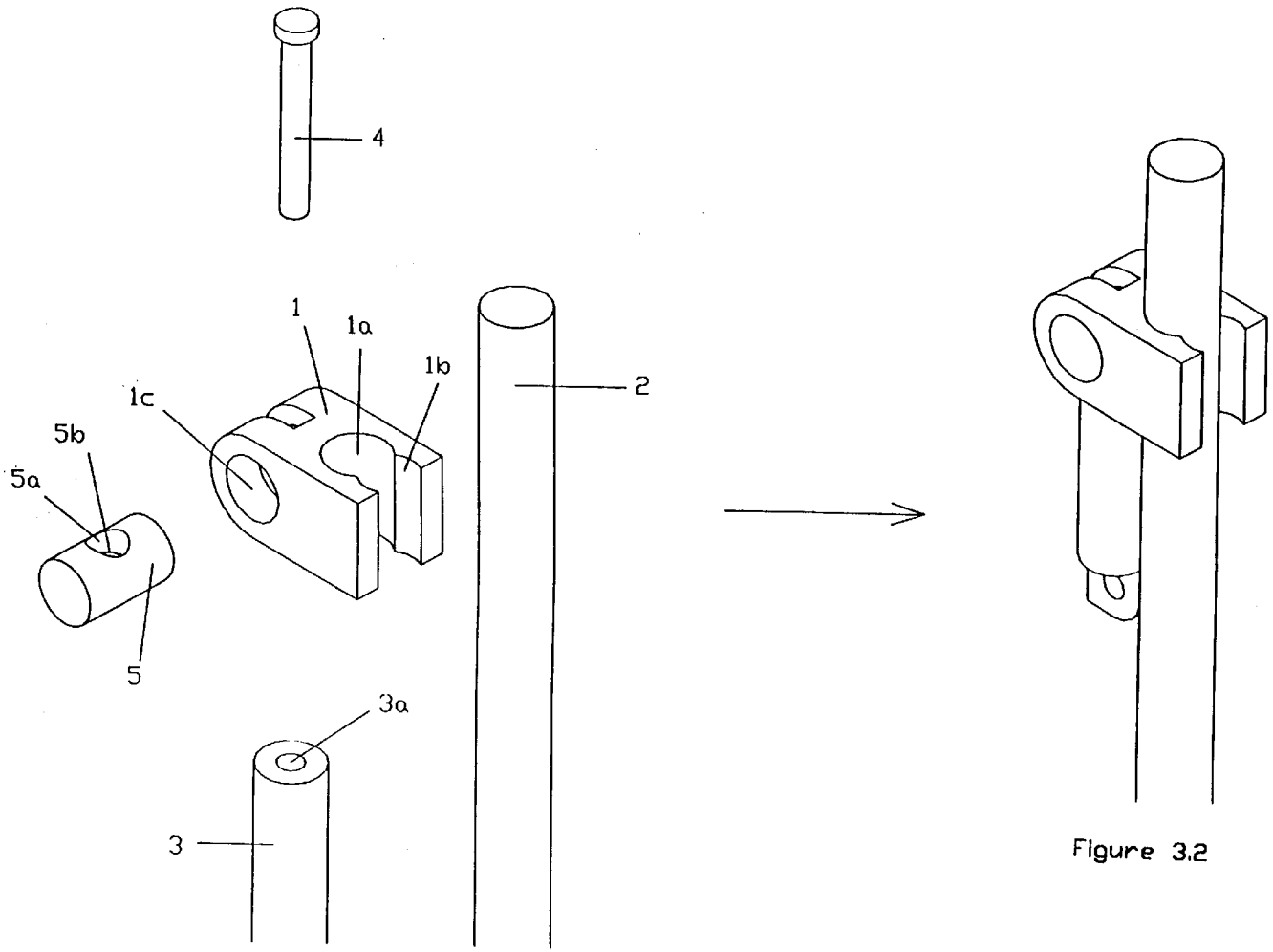
FIG. 3 shows sub-assembly of the angle fixture and its related parts.

FIG. 3 shows the sub-assembly around the angle fixture 1.

The horizontal pin 5 is inserted into the hole 1*c* in the angle fixture 1.

5 interference fits 1*c*.

The vertical pin 4 drops into the hole 5*b* in the horizontal pin 5, and 4 is held at that position by hole 5*a*.

4 clearance fits 5*a* and 5*b*.

4 is further inserted into the hole 3*a* in the upper central axis 3.

4 interference fits 3*a*.

The arm 2 goes into either the hole 1*a* or the hole 1*b* in the angle fixture 1.

2 clearance fits 1*a*.

2 interference fits 1*b*.

The purposes of the interference fit and clearance fit between these parts are as followed.

5 can be rotated and fixed at any angular position in 1*c*,

4 together with 3 can rotate freely in 5*a* and 5*b*,

2 can slide freely in 1*a*, and

2 is clamped at a position in 1*b*.

Figure 4:
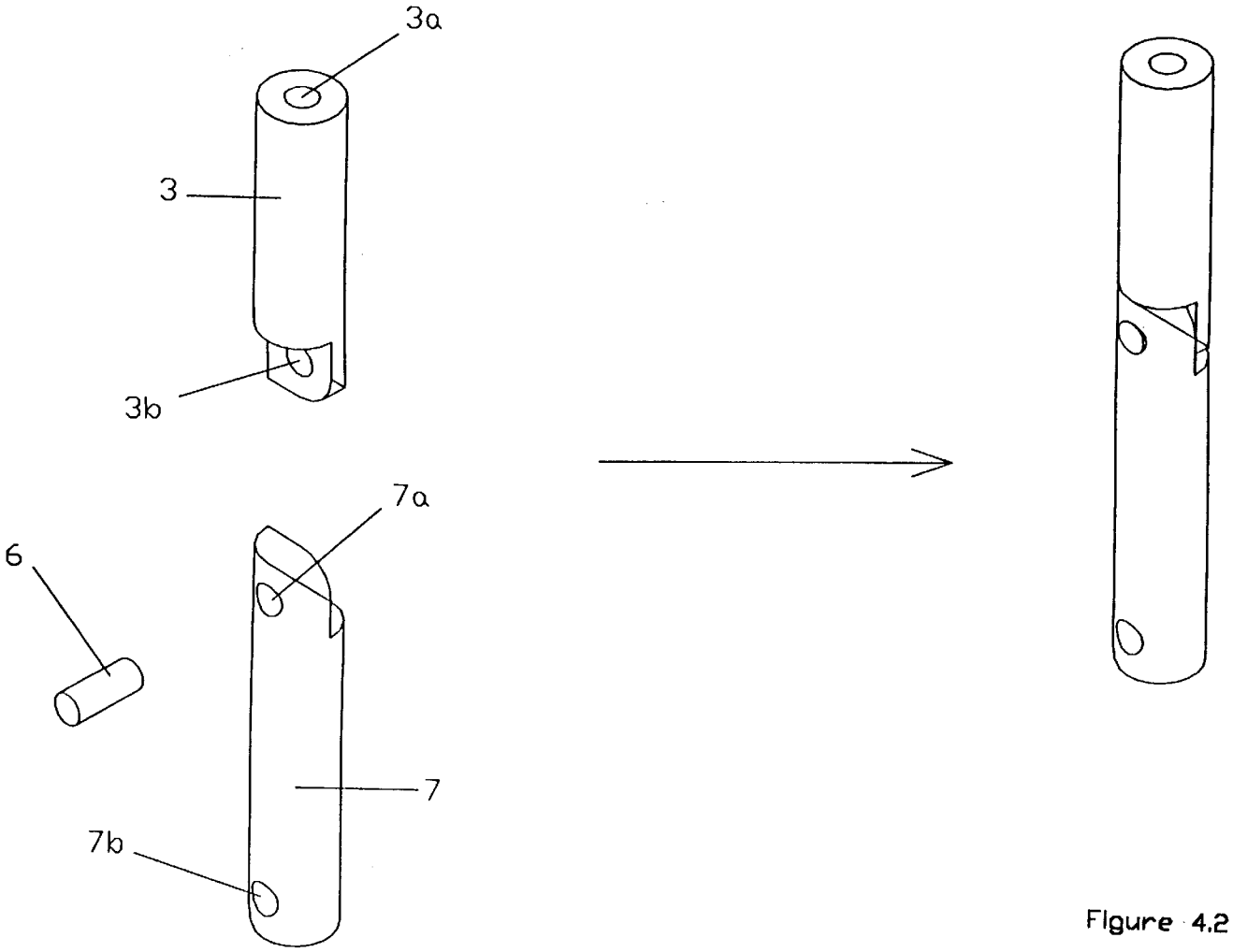
FIG. 4 shows sub-assembly of the central axis and its related parts.

FIG. 4 shows how the upper central axis 3 and the lower central axis 7 are jointed together.

The pin 6 is inserted into the hole 7*a* in the lower central axis 7 and the hole 3*b* in the upper central axis 3.

6 interference fits both 7*a* and 3*b*.

The purposes of the interference fit between these parts are as followed.

The geometry allows 3 and 7 to bend toward each other,

3 and 7 is either linear or perpendicular to each other, and

6 fixes 3 and 7 at the linear or perpendicular position.

Figure 5:
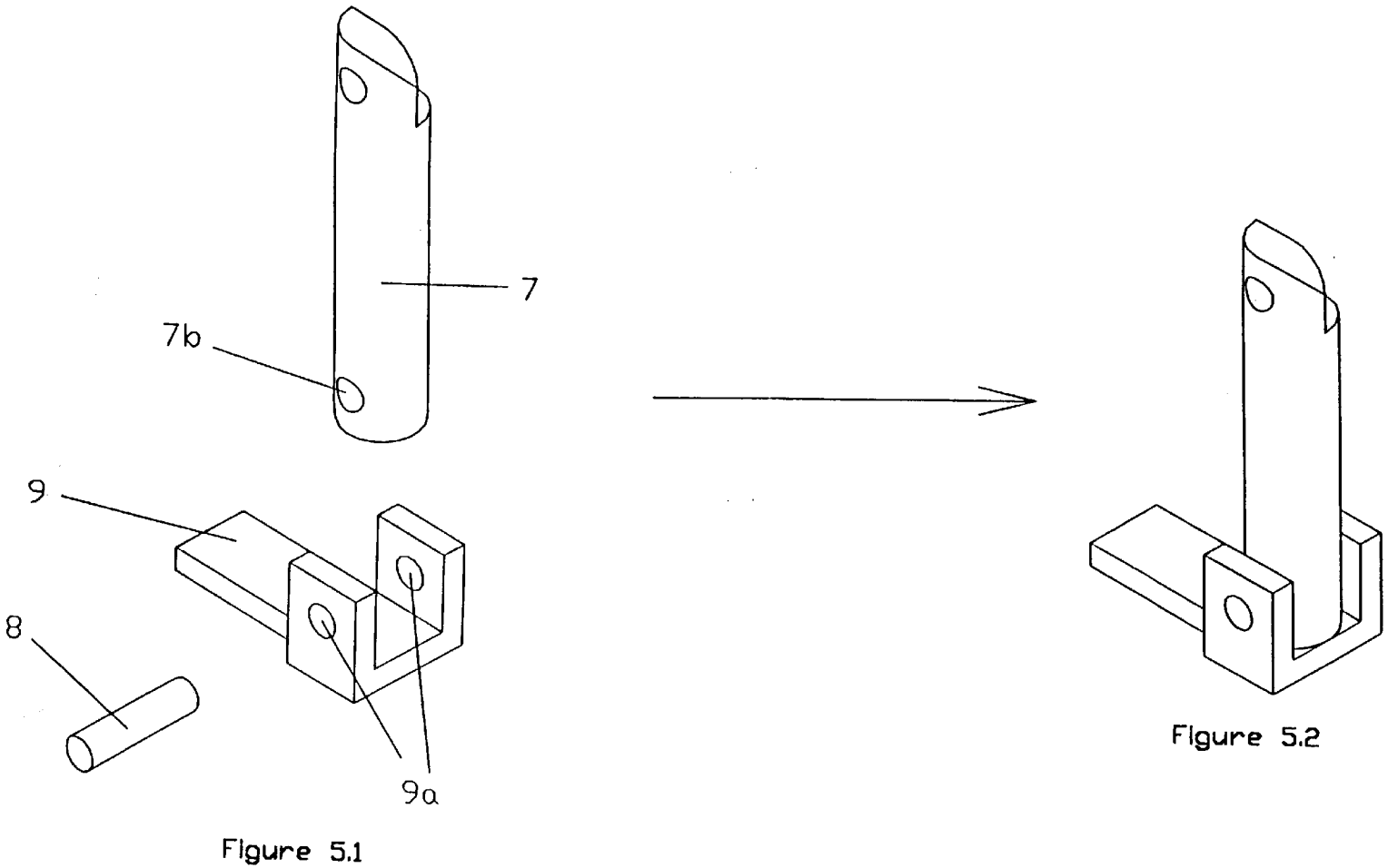
FIG. 5 shows sub-assembly of the base and its related parts.

FIG. 5 shows how the lower central axis 7 and the base 9 are jointed together.

The screw 8 is tightly screwed into the hole 9*a* in the base 9 and the hole 7*b* in the lower central axis 7.

8 screw fits both 9*a* and 7*b*.

The purpose of the screw fit here are as followed.

A greater bending moment is anticipated at this joint,

The geometry allows 7 and 9 to bend toward each other, (The fillet at the lower end of 7 is identical as the one at the upper portion; the fillet geometry at lower end of 7 is hidden in the rear view, which can not be seen from this angle.)

9 and 7 can be fixed at any angle between 0°–90°.

Again, the purpose of resisting or allowing relative motion between 2 parts will become apparent in the later section.

The side surface 1*d* on the angle fixture 1 and the side surface 9*b* on the base 9 have angular marks around the holes (which are not shown in any of the figures here). The purpose is to avoid using a protractor to measure and fix the parts at a desirable angle.

All of the interference-fit parts can be made into clearance fit. However, additional secure mean, such as using a screw to tighten a part, will be needed.

An alternative design is to eliminate the lower central axis 7 and the pin 6, and elevate the hole 9*a* in the base 9. By eliminating 7 and 6 and connecting 9 to 3, CSC can be used to draw smaller curves.

PRINCIPLE BEHINDS THE INVENTION

Figure 6:
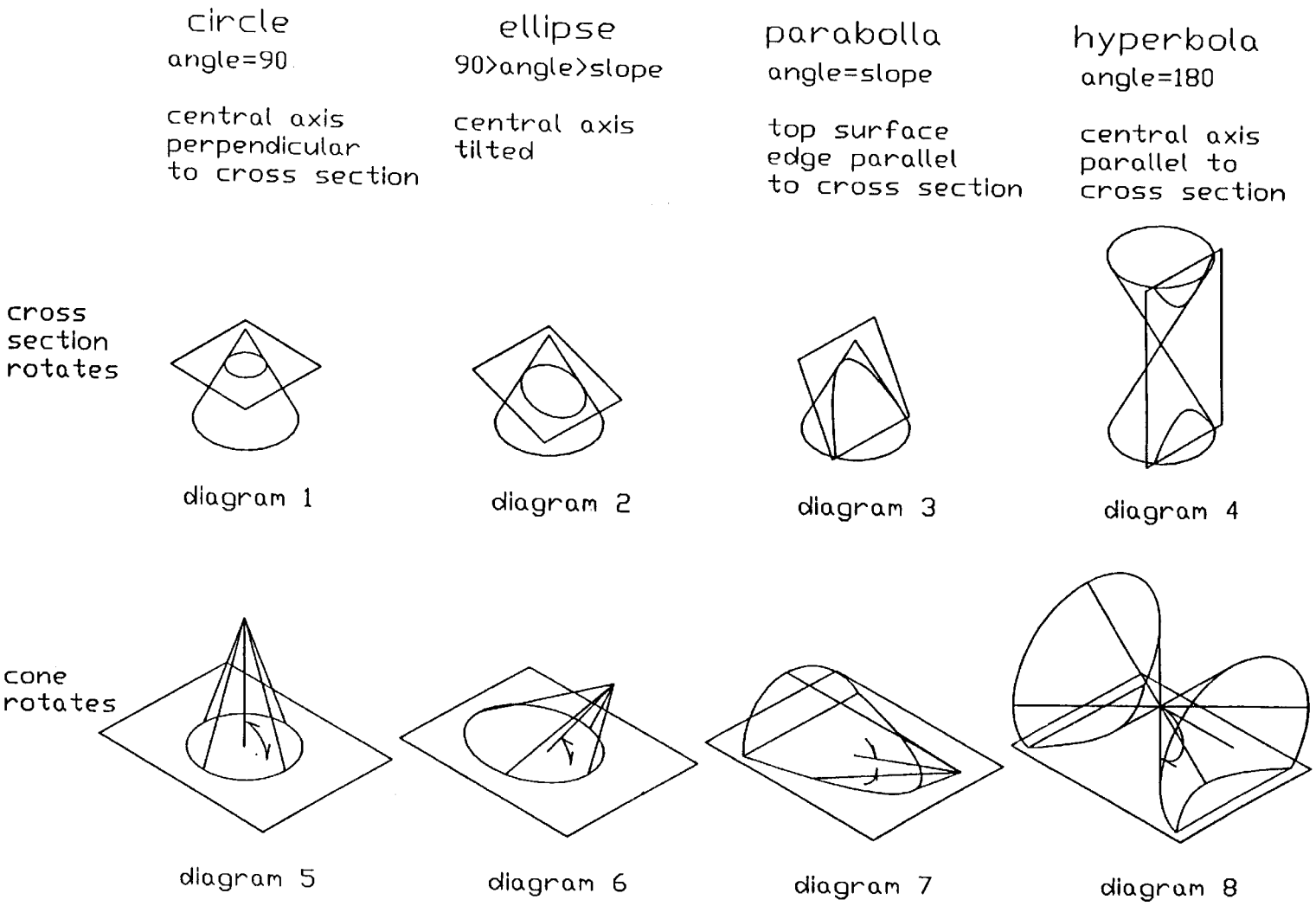
FIG. 6 shows the cone-vs-cross-section theory of the 4 curves.

FIG. 6 shows the principle which Conic Section Compass operates on—different angular cross section of a cone intersects different curve. In diagram 1–4, the plane or the cross section is tilted to intersect the cone. In diagram 5–8, the cone is tilted to intersect the plane. Either way will give us the same curve.* The intersected curves can be further broken down into 4 families—circles, ellipses, parabolas and hyperbolas.

*However, the mathematical expressions are different. Curves in Diagram 1–4 are in 3 dimensional coordinate, and the curves are expressed in terms of x, y, and z (z is hidden after solving the system of equation, leaving x and y on the projected xy plane). Curves in Diagram 5–8 are on the xy surface, thus the curves can be expressed in terms of only x and y.

If a plane is perpendicular to the central axis of the cone, a circle is intersected. See diagram 1 and 5.

If a plane is tilted to intersect the cone, an ellipse is formed. See diagram 2 and 6.

If a plane is parallel to the slope of the cone, a parabola is intersected. See diagram 3 and 7.

If a plane is parallel to the central axis of the cone, a hyperbola is intersected. See diagram 4 and 8.

Neither of the intersecting planes should contain the vertex of the cone. Otherwise, the circle and the ellipse would become a point, the parabola would become a straight line, and the hyperbola would become two intersecting straight lines.

This can also be shown by solving a system of equations, $x^2+y^2=(z/m)^2$, (a cone with slope m)

$Ax+By+Cz+D=0$, (a random plane)

$$\rightarrow ax^2+by^2+cxy+dx+fy+g=0$$

and different combination of the coefficient a and b yields the different families.

Circles $\rightarrow ax^2+by^2=r^2$, $\rightarrow a=b$, $\rightarrow$eccentricity $e=0$, Ellipses $\rightarrow ax^2+by^2=1$ $\rightarrow$sign of a=sign of b, $a\neq b$, $\rightarrow$eccentricity $e<1$, Parabolas $\rightarrow y=ax^2$ $\rightarrow b=0$, $\rightarrow$eccentricity $e=1$, Hyperbolas $\rightarrow ax^2-by^2=1$ $\rightarrow$sign of $a\neq$sign of b, $a\neq b$.

$\rightarrow$eccentricity $e>1$.

One can find references in many high school geometry text books.

From now on, circles, ellipses, parabolas and hyperbolas will be defined as the following:

a plane, a cone with a specific slope, the plane intersecting the cone at a specific distance and angle, i.e. perpendicular, tilted, parallel, etc., and the cross section and the curve is rotated to a horizontal plane, such as table top, for convention.

Figure 7:
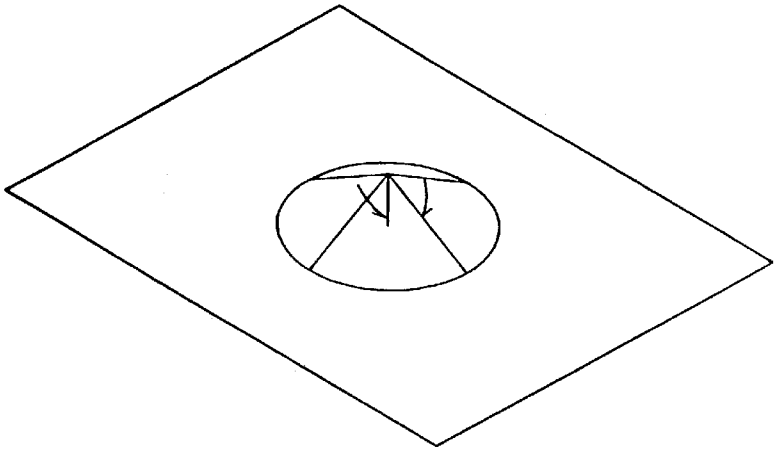
FIG. 7 shows two independent variables that determine the size and the curvature of a curve.
Figure 7:
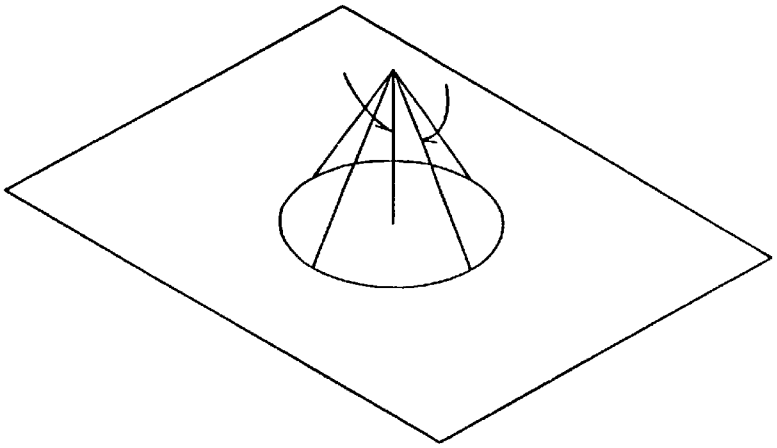

In another word, a curve is a function of a cone and a plane—Curve(cone,plane) or f(x,y). A specific curve depends on the specific slope of a cone as well as the location of the intersecting plane. FIG. 7 demonstrates this relationship.

FIG. 7 shows how a particular circle depends on the specific combination of the slope of a cone and the location of a plane. To intersect a circle with a radius equals to 2, one can use a cone with slope=tan 30°, and a cross section that is 1.155 from the vertex of the cone (the orthogonal or shortest distance). Or, one can use a cone with slope=tan 60°, and a cross section that is 3.46 from the vertex of the cone.

The same can be said about ellipses, parabolas and hyperbolas.

There are virtually infinity combinations of the two variables (the slope of a cone and the orthogonal distance from the vertex of the cone to the plane) that yield an identical curve. (FIG. 7 shows only 2 combinations for an identical circle.) It is redundant to use both variables to define a curve. To eliminate this redundancy, the orthogonal distance is fixed by the length of the central axis. Since the orthogonal distance is given, and relates to the length of the central axis, the curve can now be defined with just the slope of the cone.

Users only need to adjust the slope of the cone to draw a specific curve.

The principle behinds CSC is to make an imaginary cone in space. By setting up the slope of the cone correctly, users can:

1) position CSC on a drawing surface, 2) rotate the arm about the central axis, 3) move the arm into and out of the paper to trace a curve.

The piece of paper serves as the plane or the cross section, and rotating the arm at the slope or angle makes an imaginary cone. See FIG. 6, diagram 5–8, with FIG. 9–12 for graphic explanation.

OPERATION OF THE INVENTION

FIG. 8 is an index table for a CSC, which has a specific length of central axis. It shows what angle of the imaginary cone will yield what curve (the angle of the cone is the angle between the arm 2 and the upper central axis 3, or 90° minus the slope of the cone).

To generate and position this imaginary cone, the geometry mentioned earlier is required. First, the arm 2 needs to stay at a fixed angle (to make the slope). This is why 5 interference fits 1*c,* so the angle fixture 1 and the arm 2 can ba position at that angle. Second, CSC needs to be positioned correctly. This is why 8 screw fits both 9*a* and 7*b,* so users can hold CSC by the base 9. Third, the arm 2 needs to rotate about the central axis (to generate the imaginary cone). This is why 4 clearance fits 5*a* and 5*b,* so the angle fixture 1 and the arm 2 can rotate freely about the central axis. Finally, the arm 2 needs to move in and out of the hole la, this is why 2 clearance fits 1*a*.

Cross reference the above paragraph with FIG. 9–12 and the following descriptions.

Figure 9:
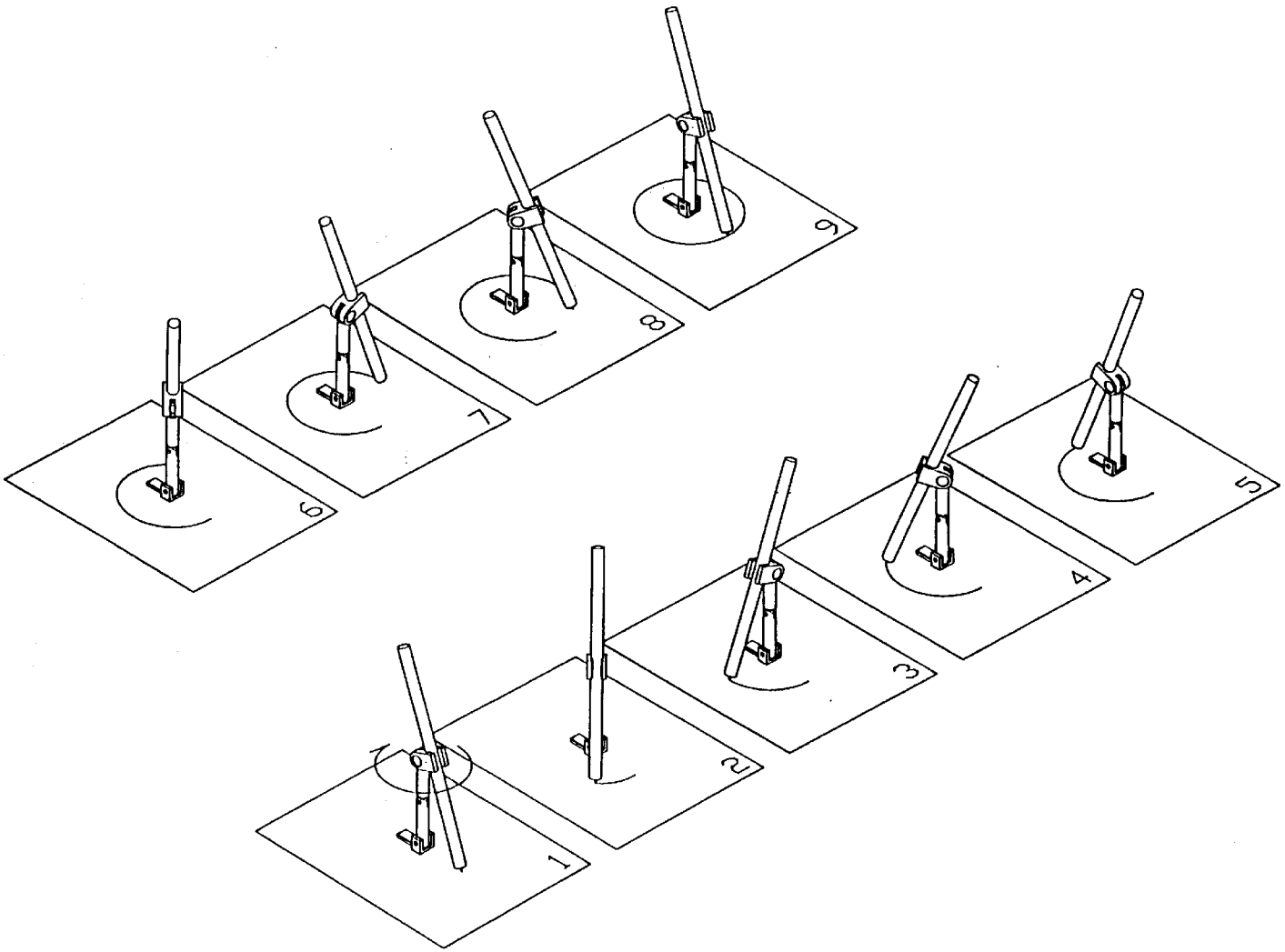
FIG. 9 is a simulation of drawing a circle with CSC.

FIG. 9 shows how to draw a circle with CSC (also cross reference with FIG. 6, diagram 5). For a circle, the base is always perpendicular to the central axis. The circle radius r, $X^2+Y^2=r^2$, depends on the angle of the cone; a larger angle of a cone makes a larger radius. Users can set the radius according to the index, or they can measure the distance from the central axis to the arm with a ruler (like using a compass). Once the angle of the cone and the base angle are set, users hold the arm 2 at any convenient location and rotate the arm 2 to trace the circle. Note that only the arm 2 is rotating, the central axis are not.

Before discussing how to draw an ellipse with CSC, readers need to realize this. The orientation of the imaginary cone for ellipses has a higher degree of freedom.** There exist infinite ellipses, given:

1) the angle of the cone, and 2) the orthogonal distance from the vertex of the cone to the plane of cross section, because the cross section can tilt within this range, 90°~90°-minus-the-slope-of-the-cone.

**The orientations of the imaginary cones for circles, parabolas and hyperbolas depend on the curves:

The central axis of the imaginary cone for circles must be perpendicular to the cross section.

The top surface edge of the imaginary cone for parabolas must be parallel to the cross section.

The central axis of the imaginary cone for hyperbolas must be parallel to the cross section.

Figure 10:
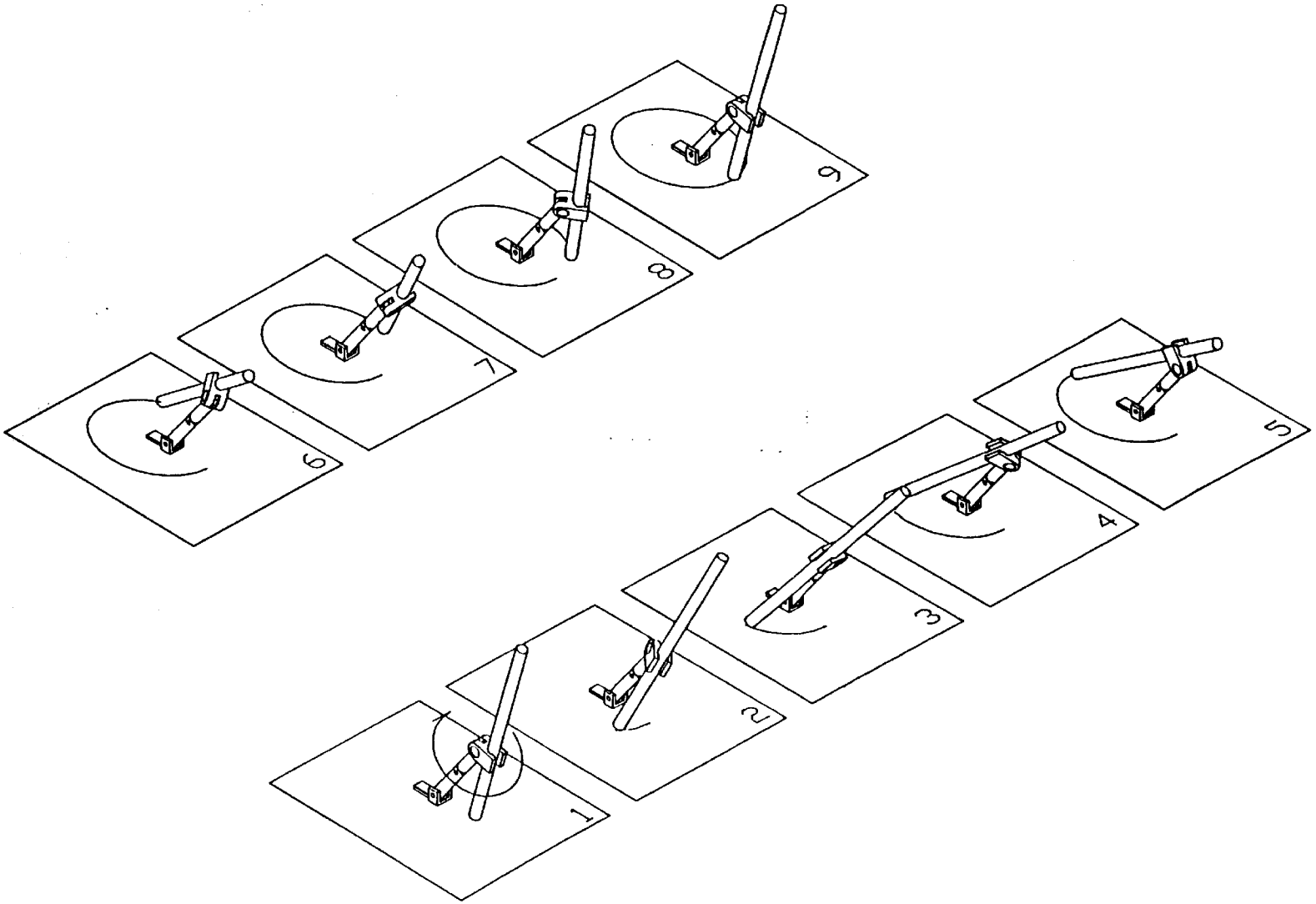
FIG. 10 is a simulation of drawing a ellipse with CSC.

FIG. 10 shows how to draw an ellipse with CSC (also cross reference with FIG. 6, diagram 6). CSC can draw any shape of the ellipses within the device range. However, an ellipse does not depend only on the angle of the cone, θ. It also depends on the angle of the base (cross section), α. This is why the index does not contain ellipse; α for circles, parabolas and hyperbolas are defined by the curves, leaving θ the only variable.

Besides, there are infinite combinations of 0 and a that generate an ellipse, $(X/a)^2+(Y/b)^2=1$, having coefficient a and b. On top of that, the ratio a/b defines the family of the similar ellipses, and a=1 ,b=3 is really "the same" ellipse as a=2,b=6. Therefore, we need to define ellipses in families of similar ellipses, a/b, with θ and α. And this relation is shown in the index (also see the article, *Dandelin Sphere,* for proof).

Once θ and α are set, users hold the arm 2 at any convenient location, rotate the arm 2, and move the arm 2 "in and out" of the hole to trace the ellipse.

Figure 11:
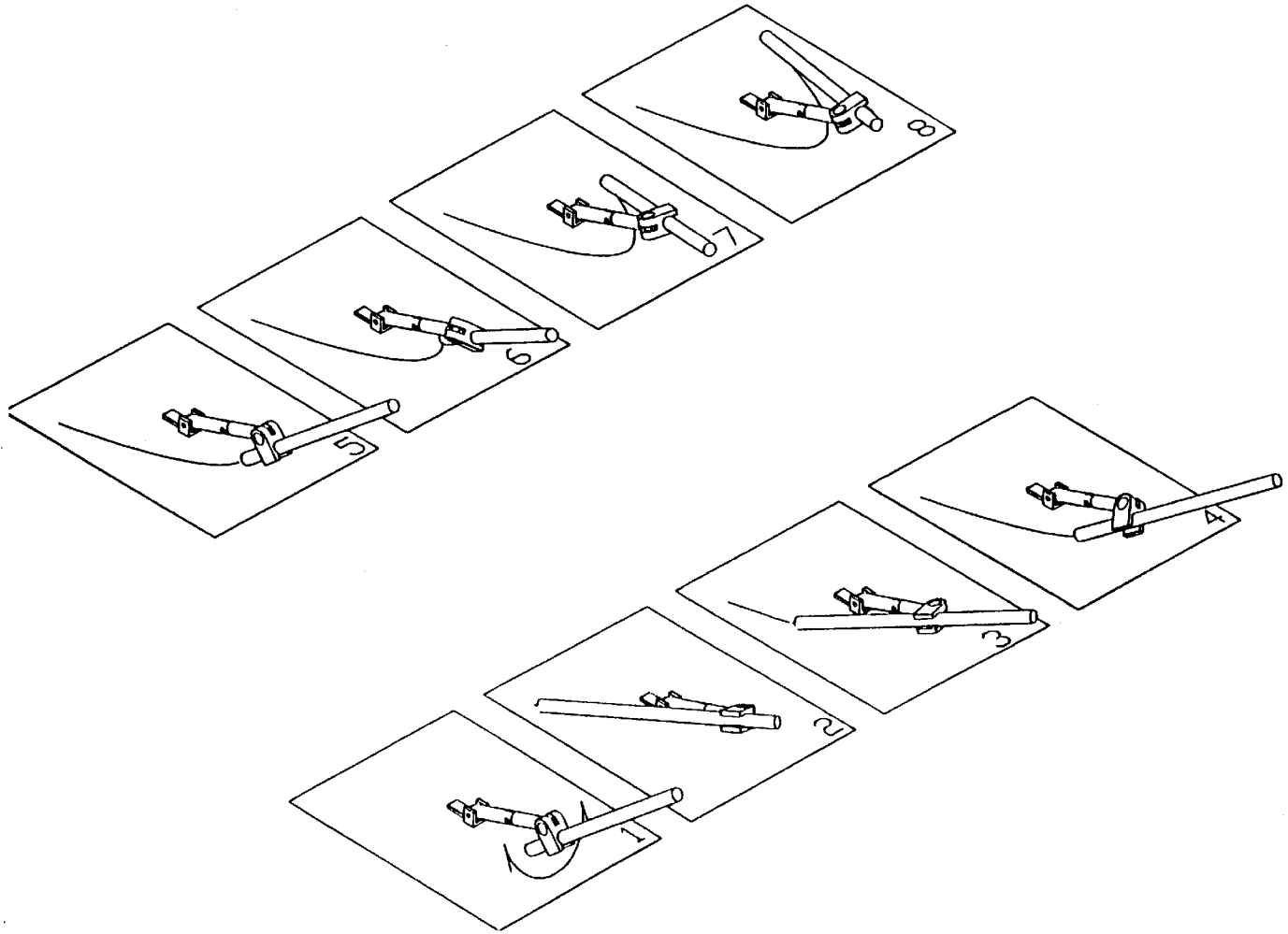
FIG. 11 is a simulation of drawing a parabola with CSC.

FIG. 11 shows how to draw a parabola with CSC (also cross reference with FIG. 6, diagram 7). For a parabola, the base is always at the same angle as the angle of the cone. This makes the top surface edge of the imaginary cone parallel to the paper/cross section. If the coefficient of the parabola is a, $Y=aX^2$, users set the base angle equals to the angle of the cone according to the index. Once the angle of the cone and the base angle are set, users hold the arm 2 at any convenient location, rotate the arm 2, and move the arm 2 "in and out" of the hole to trace the parabola.

Figure 12:
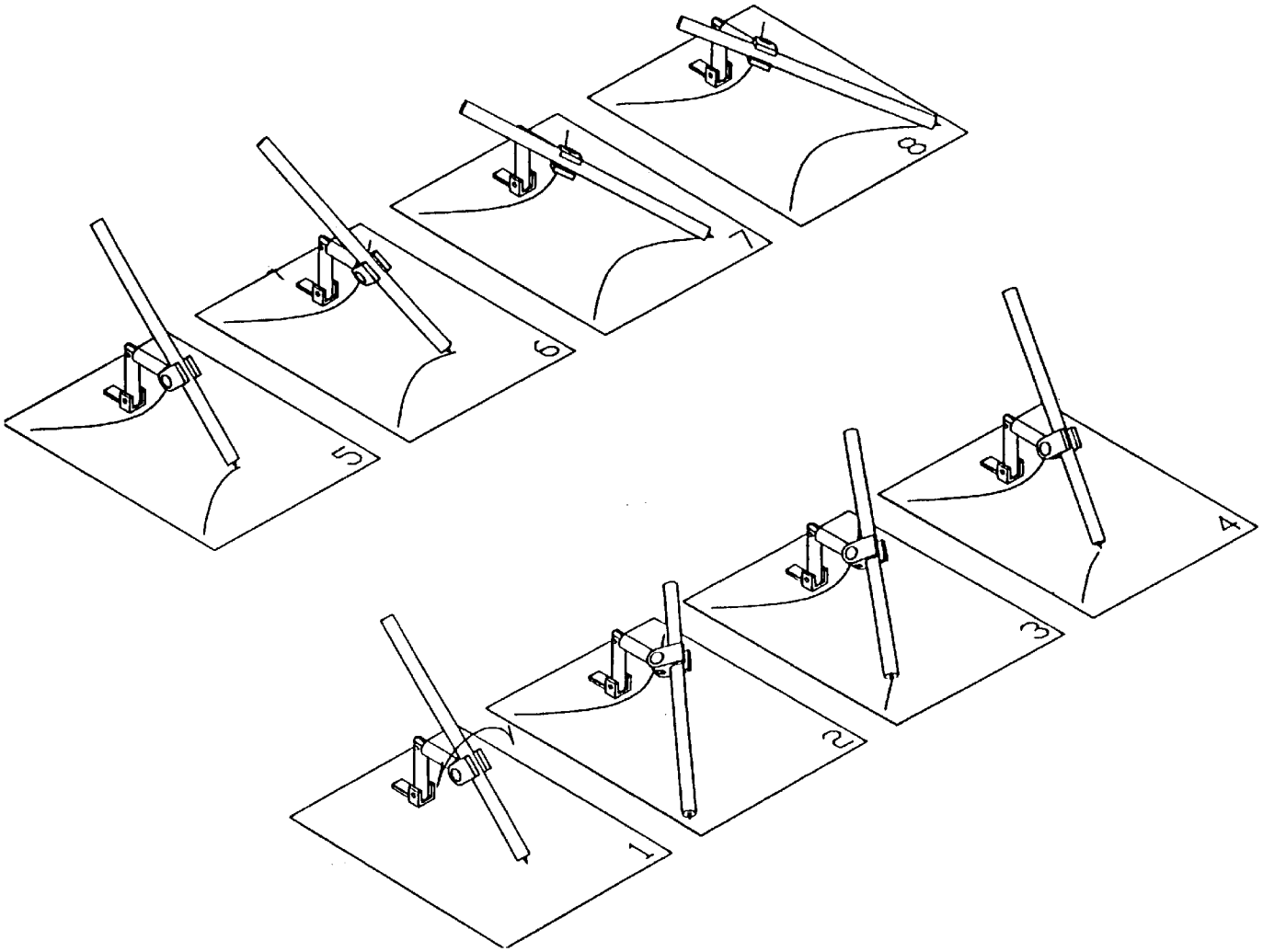
FIG. 12 is a simulation of drawing a hyperbola with CSC.

FIG. 12 shows how to draw a hyperbola with CSC (also cross reference with FIG. 6, diagram 8). For a hyperbola, the base is always perpendicular to the lower central axis 7, and the lower central axis 7 is also always perpendicular to the upper central axis 3. At this position, the upper central axis 3 is always parallel to the paper/cross section. To draw a particular hyperbola, users set the angle of the cone according to the index. Since a hyperbola has two coefficients a and b, and hyperbolas are in families of similar hyperbolas $\{(X/4)^2-(Y/5)^2=1$ is "the same" as $(X/8)^2-(Y/10)^2=1\}$, the index is written in the ratio of a/b, $(X/a)^2-(Y/b)^2=1$. Once the angle of the cone, the base angle, and the central axis angle are set, users hold the arm 2 at any convenient location, rotate the arm 2, and move the arm 2 "in and out" of the hole to trace the hyperbola. Since a hyperbola is symmetrical along a mirror line, users need to make another identical curve symmetry to the first one.

DISCUSSION OF THE PRIOR ARTS

People are very familiar to Circle Maker Apparatus, or a compass, U.S. Pat. No. 3,537,181. Using a compass is common knowledge and simple. However, the needle on a compass always leaves a hole on the piece of drawing paper. Besides, the needle usually penetrates several sheets of paper beneath the surface sheet, and it also leaves holes on them. If the drawing paper is placed on a hard surface, like the table top, the needle sometimes slides slightly, and the hole becomes larger.

Less familiar to the public is the ellipsographs. There exists many different patented ellipsographs. They are listed on Form PTO-1449. They can generally be broken down into two types: the board type and the compass type. The board type lays flat on the drawing surface, and the compass type stands up on the drawing surface.

Due to the physical dimension, the board type seems to make large ellipses only. This is a disadvantage to drawing on an A-size paper (or any small format). Besides, most of them are consisted of too many components, and their driving mechanism seem complicated. The structure of the board type ellipsograph is fundamentally different from Conic Section Compass. Patentbility of CSC should not be an issue here.

U.S. Pat. No. 3,719,996 is an ellipsograph of compass type. CSC is not comprised of a spring or a bow-shaped pantograph, as claimed in this ellipsograph. Therefore, CSC does not infringe this ellipsograph. Besides, their mechanism to draw ellipses are fundamentally different.

U.S. Pat. No. 4,169,315 is another ellipsograph of compass type. The central rod in this ellipsograph may seem similar to the central axis or the axially supporting mean in CSC. However, the central rod in this ellipsograph is always perpendicular to the drawing surface, and the central axis in CSC isn't. The central axis in CSC is always at an angle when drawing ellipses. Besides, this ellipsograph claims a pair of horizontal beams that secure and extends outward from central rod. CSC does not comprise such beams. Their mechanism to project ellipses are fundamentally different too.

U.S. Pat. No. 4,045,875 is also an ellipsograph of compass type. The structures between the two may seem dissimilar at first. However, both CSC and this ellipsograph apply the same mathematical concept—different angular cross sections of an imaginary cone project ellipses. CSC is almost identical as this ellipsograph, except that CSC does not comprise of a crank arm (their driving mechanisms are different).

Besides, U.S. Pat. No. 4,045,875 is an ellipsograph. It is an drafting apparatus to draw ellipses only. CSC is not only for drawing circles and ellipses, it is also for drawing parabolas and hyperbolas.

No prior art was found for devices which are used to draw parabolas or hyperbolas.

CONCLUSION

Conic Section Compass is an innovated apparatus.

CSC can be used to draw or make curvature of the second degree polynomial curves. Given a second degree polynomial, users can look up in the index, and find the settings to draw the specific curve. Once CSC is set, users hold the base and rotate the arm to trace the curve.

CSC is simple to use, easy to carry, and it gives precise large and small graphs.

I claim:

1. A hand-held drawing device that helps users to draw circles, ellipses, parabolas, hyperbolas or make surface curvature of these types comprising:

a guiding extension, an axially supporting mean having an angle fixing mean attached at one end for 1) enabling said guiding extension to be positioned at a desirable angle relative to said axially supporting mean, 2) enabling said guiding extension to rotate about said axially supporting mean at said angle, 3) enabling said guiding extension to slide in said angular direction during said rotation.

a holding mean attached at the other end of said axially supporting mean for positioning said axially supporting mean at an angle relative to a drawing surface.

* * * * *